US006666220B2

(12) United States Patent
Spanyer et al.

(10) Patent No.: US 6,666,220 B2
(45) Date of Patent: Dec. 23, 2003

(54) COOKWARE WASHER

(75) Inventors: Andrew Joseph Spanyer, Louisville, KY (US); Kenneth D. Tripp, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,790

(22) Filed: Oct. 18, 2001

(65) Prior Publication Data

US 2003/0075206 A1 Apr. 24, 2003

(51) Int. Cl.[7] ..... B08B 3/02

(52) U.S. Cl. ..... 134/58 D; 134/135; 134/199; 134/200; 211/41.8

(58) Field of Search ..... 134/56 D, 57 D, 134/58 D, 199, 200, 135; 211/41.8

(56) References Cited

U.S. PATENT DOCUMENTS

| | | | | |
|---|---|---|---|---|
| 1,946,181 | A | * | 2/1934 | Stoddard |
| 1,975,760 | A | * | 10/1934 | Arbenz |
| 2,426,291 | A | * | 8/1947 | Abrams |
| 2,620,811 | A | * | 12/1952 | Walker |
| 2,710,617 | A | * | 6/1955 | James et al. |
| 2,734,520 | A | * | 2/1956 | Abresch et al. |
| 2,739,025 | A | * | 3/1956 | Stoddard |
| 2,910,207 | A | * | 10/1959 | Andrew |
| 3,001,227 | A | * | 9/1961 | Long et al. |
| 3,040,901 | A | * | 6/1962 | Andrew |
| 3,095,885 | A | * | 7/1963 | Hertell |
| 3,118,458 | A | * | 1/1964 | Dannenmann et al. |
| 3,126,098 | A | * | 3/1964 | Geiger et al. |
| 3,330,576 | A | * | 7/1967 | Willis |
| 3,568,848 | A | * | 3/1971 | Tzifkansky |
| 3,759,276 | A | * | 9/1973 | Nolte |
| 4,004,600 | A | * | 1/1977 | Corn et al. |
| 4,021,088 | A | * | 5/1977 | Murray |
| 4,064,888 | A | * | 12/1977 | Diebel |
| 4,106,517 | A | * | 8/1978 | Wright |
| 4,126,485 | A | * | 11/1978 | Sadwith |
| 4,134,003 | A | * | 1/1979 | Hahn |
| 4,241,400 | A | * | 12/1980 | Kiefer |
| 4,475,656 | A | * | 10/1984 | Collier |
| 4,653,520 | A | * | 3/1987 | Alvemarker |
| 4,735,219 | A | * | 4/1988 | Seeland |
| 4,773,436 | A | | 9/1988 | Cantrell et al. |
| 5,131,419 | A | | 7/1992 | Roberts |
| 5,201,826 | A | * | 4/1993 | Zimmermann |
| 5,331,986 | A | * | 7/1994 | Lim et al. |
| 5,462,348 | A | | 10/1995 | Ellingson et al. |
| 5,560,060 | A | * | 10/1996 | Dausch et al. |
| 5,586,567 | A | * | 12/1996 | Smith et al. |
| 5,611,867 | A | * | 3/1997 | Cooper et al. |
| 5,749,385 | A | * | 5/1998 | Rochette et al. |
| 5,924,433 | A | * | 7/1999 | Thies et al. |
| 6,463,940 | B1 | * | 10/2002 | Thomas et al. |

FOREIGN PATENT DOCUMENTS

| | | | |
|---|---|---|---|
| GB | 2359248 | * | 8/2001 |
| JP | 4-90738 | * | 3/1992 |
| JP | 4-269934 | * | 9/1992 |
| JP | 5-76474 | * | 3/1993 |
| JP | 6-217920 | * | 8/1994 |

OTHER PUBLICATIONS 143,754 European Patent Office May 1985.*

* cited by examiner

*Primary Examiner*—Frankie L. Stinson
(74) *Attorney, Agent, or Firm*—George L. Rideout, Jr., Esq; Armstrong Teasdale, LLP

(57) ABSTRACT

A cookware washer includes a wash chamber, and a lower rack positioned within said wash chamber. The lower rack includes a substantially unobstructed bottom surface.

18 Claims, 3 Drawing Sheets

COOKWARE WASHER

BACKGROUND OF INVENTION

This invention relates generally to domestic warewashing machines and systems, and more particularly to a domestic warewasher system adapted for washing cookware.

Known domestic dishwasher systems for residential use include a cabinet, a tub within the cabinet that defines an open sided wash chamber, and a door assembly that seals the open side of the wash chamber when the dishwasher is in use. The door assembly is attached to the dishwasher at a bottom end of the door and pivots about a hinge between fully open and fully closed positions, and dishes, glasses, utensils, food and beverage containers, etc., are loaded onto and from roller-equipped racks before and after operation of the dishwasher. The wash chamber includes a sump portion where washing fluid is pumped from a fluid circulation assembly through spray arm conduits to wash items loaded onto dishwasher racks in the wash chamber, and also where wash fluid is collected after being circulated throughout the wash chamber.

Conventionally, and despite the presence of a dishwasher, certain items are washed by hand instead of in the dishwasher. For example, some items, including larger cookware items such as pots and pans, lids, casserole dishes serving platters, and large cooking utensils are too large to fit in the dishwasher or of a shape that cannot be adequately accommodated by the dishwasher racks. In addition, while some dishwasher systems have specially designed cycles for pots and pans, the aforementioned difficulties in loading pots and pans into dishwasher racks often negates their use, and furthermore, experience has shown that baked-on adhered soils and residue typically remain after completion of such cycles. Still further, some manufacturers recommend against the use of certain cookware with dishwasher systems due to chemical resistance issues with detergents used in dishwasher systems. For at least these reasons, the belief that optimum washing and drying of cookware in conventional systems cannot be realized has taken root, and most residential users therefore hand wash and hand dry cookware and utensils with baked-on adhered soils, while the dishwasher is reserved for washing dishes, flatware, and eating utensils with non-baked on soils.

While specialized utensil holders have been developed to accommodate odd-shaped utensils, such as spatulas, serving spoons, ladles, tongs, long knives, etc., see, for example, U.S. Pat. No. 5,462,348, it has been generally found that conventional dishwasher cycles do not adequately clean such items, especially when they contain baked-on adhered soil and residue. Further, commercial pot and pan washing machines are available for use in the food service industry. See, for example, U.S. Pat. Nos. 5,131,419, 4,773,436, and 4,653,520. The large size and high cost of these units, however, render them generally impractical and unjustifiable for home use.

SUMMARY OF INVENTION

In one aspect, a cookware washer is provided. The cookware washer comprises a wash chamber, and a lower rack positioned within said wash chamber. The lower rack comprises a substantially unobstructed bottom surface.

In another aspect, a cookware washer is provided that comprises a wash chamber and a lower rack slidably coupled to said wash chamber. The lower rack comprises a substantially flat and unobstructed bottom surface adapted for retaining cookware. The cookware washer also comprises a fluid circulation assembly comprising a lower spray arm assembly proximate said lower rack, and a controller operatively coupled to said fluid circulation assembly. The controller is configured to operate said fluid circulation assembly for an extended time period and at elevated temperatures to clean soiled cookware items.

In still another aspect, a cookware washer for washing cookware items having baked-on food residue is provided. The cookware washer comprises a tub comprising a wash chamber, an upper rack coupled to said wash chamber and comprising a substantially flat bottom surface adapted for retaining cookware items, a lower rack coupled to said wash chamber and comprising a substantially flat bottom surface adapted for retaining cookware items, a fluid circulation assembly in flow communication with said wash chamber, and a controller operatively coupled to said fluid circulation assembly. Each of said upper and lower rack is horizontally positionable within said wash chamber, and the controller is configured to operate said fluid circulation assembly for an extended time period and at elevated temperatures to remove baked-on residue.

In yet another aspect, a residential cookware washer for washing cookware items having baked-on food residue is provided. The cookware washer comprises a tub comprising a wash chamber and at least one heavy duty rack coupled to said tub and adapted for horizontal movement between an extended position and a retracted position relative to said wash chamber. The at least one rack comprises a substantially flat bottom surface adapted for retaining cookware items, and said at least one rack is located in said wash chamber to provide a vertical clearance of at least 14 inches for cookware items. A door assembly is pivotally mounted to said tub and selectively positionable about a horizontal axis between an open position providing access to said wash chamber and a closed position closing said wash chamber. A fluid circulation assembly is in flow communication with said wash chamber and a controller is operatively coupled to said fluid circulation assembly and is configured to operate said fluid circulation assembly for an extended time period and at elevated temperatures to remove baked-on residue from cookware located in said at least one rack.

DETAILED DESCRIPTION

Figure 1:
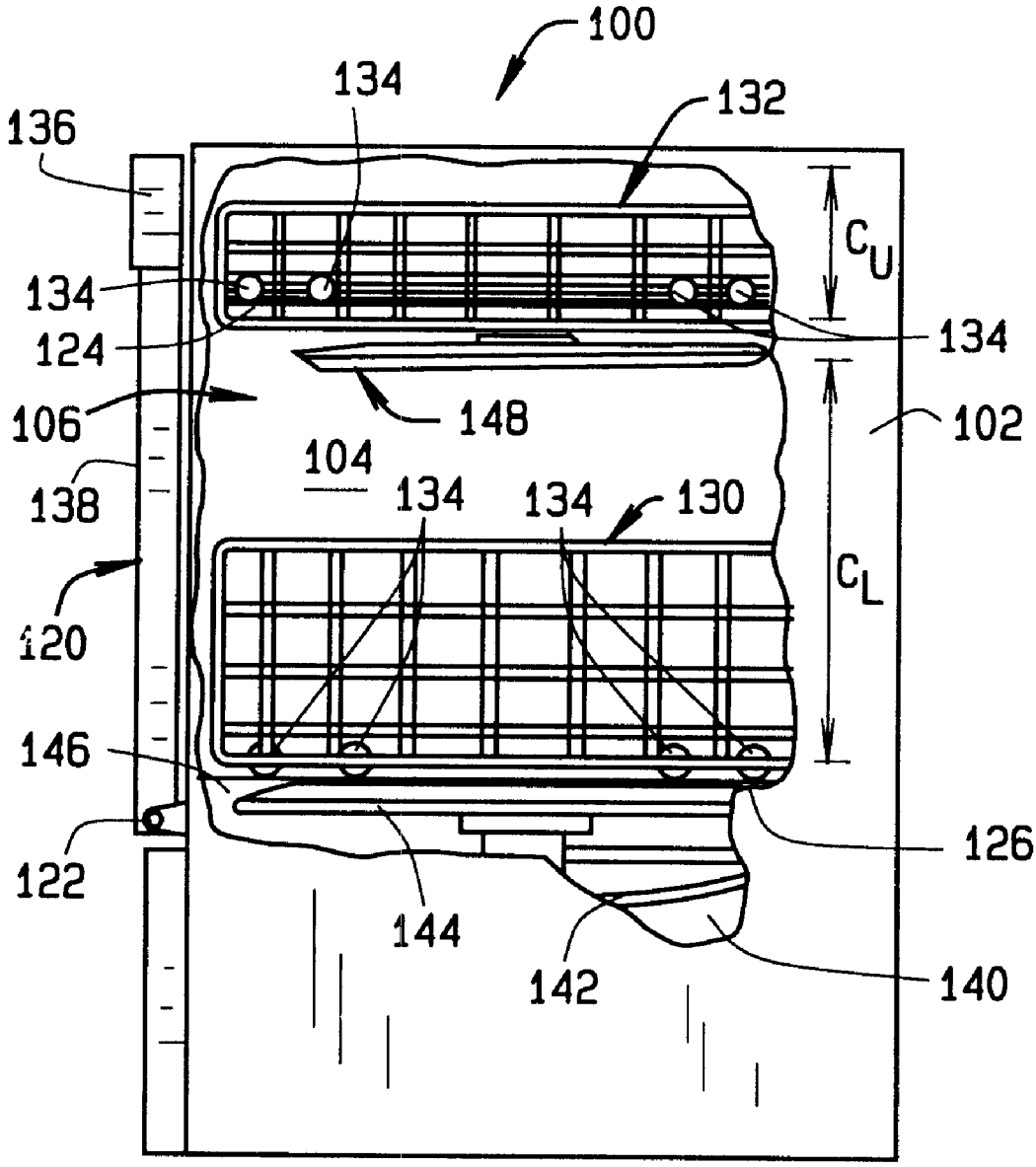
FIG. 1 is a side elevational view of an exemplary cookware washer system.

FIG. 1 is a side elevational view of an exemplary cookware washer system 100 suitable for domestic, or residential, use. As used herein cookware shall refer generally to cooking utensils and items used predominately for food preparation, and therefore likely to encounter hard-to-clean baked-on residue and caked foodstuffs in use, as opposed to relatively lightly soiled flatware used predominately for food serving (e.g., serving plates, silverware, glassware and food storage containers) which is manageable by conventional dishwasher systems. For example, and unlike conventional dishwasher systems, cookware washer 100 is especially suited for pots and pans, lids for pots and pans, casserole dishes, serving platters, cookie sheets, mixing bowls, baking dishes, rotisserie pans, cutting boards, colanders cake pans, broiler inserts, graters, measuring cups, and large cooking utensils such as spatulas, serving spoons, ladles, tongs, and long knives that are generally incompatible with conventional dishwashers. Thus, cookware washer 100 is intended primarily for cookware items that conventionally are not washed in conventional dishwashers due to size constraints and baked-on adhered residue that is beyond the cleaning capability of conventional dishwashers. It is contemplated, however, that cookware washer 100 may be employed to wash heavily soiled flatware in addition to cookware.

Cookware washer 100 includes a cabinet 102 having a tub 104 therein and forming a wash chamber 106. Tub 104 includes a front opening (not shown in FIG. 1) and a door assembly 120 hinged at its bottom 122 for movement about a horizontal axis between a normally closed vertical position (shown in FIG. 1) wherein wash chamber 106 is sealed shut for washing operation, and a horizontal open position (shown in FIG. 2) for loading and unloading of cookware from wash chamber 106. Upper and lower guide rails 124, 126 are mounted on side walls of tub 104 and accommodate a lower cookware rack 130 and an upper cookware rack 132 respectively.

In one embodiment, each of racks 130, 132 is fabricated from steel and coated with a durable nylon material into a into a heavy duty lattice structure. The lattice structure is stronger and fabricated from a greater diameter wire material than conventional dishwasher racks. Lower rack 132 is taller than conventional dishwasher racks and therefore suited, as further described below, for accommodating larger cookware such as pots and pans. Upper rack 132, as also described below is adapted to accommodate smaller cookware and cooking items. Each rack 130, 132 is adapted for horizontal movement on rollers 134 between an extended loading position (not shown) in which the rack is substantially positioned outside wash chamber 106, and a retracted position (shown in FIG. 1) in which the rack is located inside wash chamber 106. Additional rollers 134 are employed on each side of rack 130, 132 due to increased weight of cookware items relative to flatware items used with conventional dishwasher systems. A cookware utensil basket (not shown in FIG. 1) is removably attached to lower rack 132 for placement of cookware utensils.

A control panel (not shown in FIG. 1) is integrated into an escutcheon 136 that is mounted to door assembly 120, or in further and/or alternative embodiments control selectors, (e.g., buttons, switches or knobs) or control displays, etc. may be mounted at a convenient location on an outer face 138 of door assembly 120. The control panel and associated selectors and displays are coupled to control circuitry (not shown) and control mechanisms (not shown in FIG. 1) for operating a fluid circulation assembly (not shown in FIG. 1) that circulates water and wash fluid in cookware washer tub 104. The fluid circulation assembly is located in a machinery compartment 140 located below a bottom sump portion 142 of tub 104.

A lower spray-arm-assembly 144 is rotatably mounted within a lower region 146 of wash chamber 106 and above tub sump portion 142 so as to rotate in relatively close proximity to lower rack 130. A mid-level spray-arm assembly 148 is located in an upper region of wash chamber 106 and is located in close proximity to upper rack 132 and at a sufficient height above lower rack 130 to accommodate a largest cookware item that is expected to be placed in lower rack 130 and washed in cookware washer 100. In one embodiment, lower rack 130 and mid-level spray arm assembly are positioned relative to one another such that a vertical clearance $C_L$ of approximately 15 inches is created between a bottom of lower rack 130 and mid-level spray-arm assembly 148. As such, lower rack 130 may accommodate items of a larger size than conventional flatware such as, for example, a 14 inch circular cutting board or a 10 inch by 14 inch cookie sheet.

In a further embodiment, an upper spray arm assembly (not shown) is located above upper rack 130 at a sufficient height to accommodate cookware items. Upper rack 132 is positioned with respect the upper spray-arm assembly such that a second vertical clearance $C_U$ is created to accommodate a largest cookware item expected to be washed in upper rack 132. For example, in an illustrative embodiment, clearance $C_U$ is sufficient to accommodate a 3 quart mixing bowl.

It is noted that in one embodiment, clearances $C_U$ and $C_L$ are accommodated in a tub 104 that is sized approximately equal to conventional dishwasher systems. As such, cookware washer 100 may be installed under-the-counter in a residential kitchen in a similar fashion to known dishwashers. It is contemplated, however, that dimensions of tub 104 may be varied to produce washers of varied capacities.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 132, 130, respectively. The arrangement of the discharge ports in at least lower spray-arm assembly 144 provides a rotational force by virtue of washing fluid flowing through the discharge ports. The resultant rotation of lower spray-arm assembly 144 provides coverage of cookware with a washing spray. In various alternative embodiments, mid-level spray arm 148 and/or the upper spray arm are also rotatably mounted and configured to generate a swirling spray pattern above and below upper rack 132 when the fluid circulation assembly is activated and door assembly 120 is properly closed to seal wash chamber 106 for operation.

Figure 2:
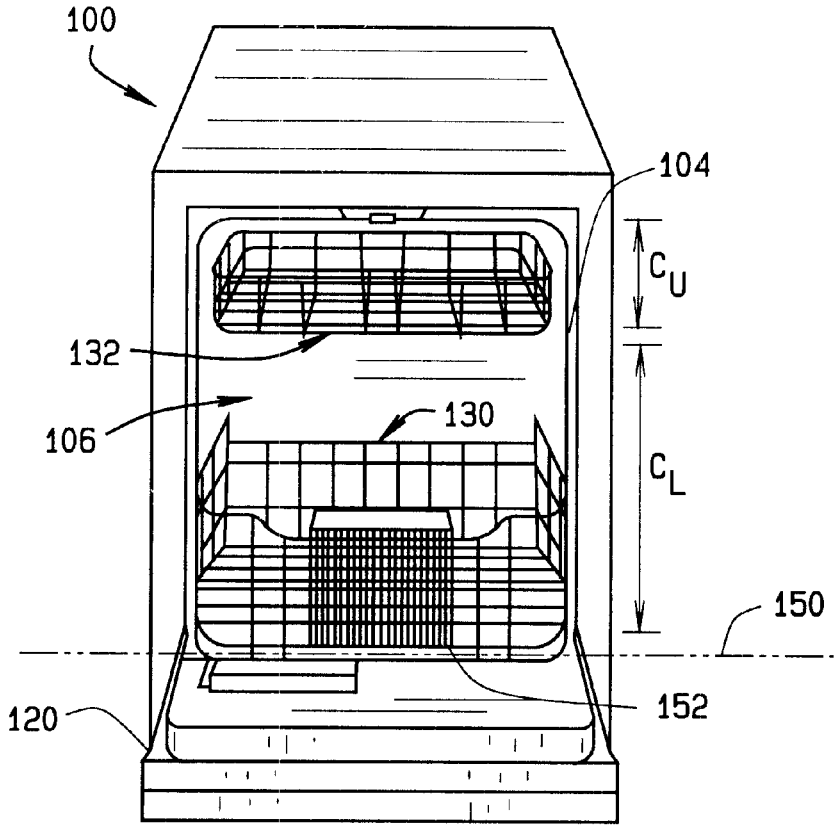
FIG. 2 is a front perspective view of the cookware washer shown in FIG. 1.

FIG. 2 is a front perspective view of cookware washer 100 with upper and lower spray arm assemblies 144, 148 (shown in FIG. 1) removed. Door assembly 120 is pivoted about a horizontal axis 150 extending through the door assembly hinge to an open position wherein racks 130, 132 may be loaded and unloaded. Racks 130, 132 are sized and dimensioned to substantially fill wash chamber 106 when racks 130, 132 are fully loaded with cookware items. Lower rack 130 is taller than upper rack 132 to accommodate taller items within rack 130. Both racks 130, 132 are generally open and free from obstructions common to known dishwasher racks that may hinder or prevent placement of cookware therein. Lower rack 130 includes a utensil basket 152 for convenient loading and unloading of cooking utensils Racks 130, 132 and clearances $C_U$ and $C_L$ permit loading of cookware item combinations that are not possible in conventional dishwashers. For example, in one illustrative embodiment, lower rack 130 has been found capable of holding a ceramic cooking tray, a 14 inch circular cooking board, a rotisserie pan, a 10 inch frying pan, a 7 quart pasta tray, two graters, and a 24 oz. glass baking dish, while upper rack 132 has been found to simultaneously contain a 1.5 quart mixing bowl, a 3 quart mixing bowl, a 10 inch frying pan, and a 2.5 liter backing dish. Thus, all these cookware items can be washed at once in cookware washer 100.

In another illustrative example, the following items may be contained in racks 130, 132 and may be simultaneously washed in cookware washer 100. A 3 quart mixing bowl, a 1.5 quart mixing bowl, a 9 inch round cake pan, and a 10 inch square cake pan may be loaded in upper rack 132, while lower rack 130 contains a 14 inch by 17.5 inch cookie sheet, a 10 inch by 14 inch cookie sheet, an 8 inch square cake pan, a 4 quart double broiler insert, a 5 quart colander, an 8 inch ceramic baking dish, a 10 inch ceramic baking dish, a measuring cup, and a variety of cookware utensils in utensil basket 150.

In yet another illustrative example to illustrate the versatility of cookware washer 100, the following items may be washed together in cookware washer 100. Two 10 inch frying pans, a 1.5 quart mixing bowl, and a 3 quart mixing bowl may be loaded in upper rack 132, while a rotisserie pan, a 7 quart mixing bowl, a 14 inch frying pan, a 4 quart sauce pan, and a 12 quart stock pot may be loaded into lower rack 130.

It is therefore evident that many other combinations of cookware items may be employed in cookware washer 100 that may not be contained in a conventional dishwasher system. When used in conjunction with a conventional dishwasher in the home, cookware washer 100 facilitates washing of cookware for a complete meal and the dishwasher facilitates washing of flatware for serving the meal with virtually no washing of items by hand. Thus, time consuming kitchen clean-up and cookware washing is substantially reduced and valuable time may be reserved for other more desirable pursuits.

Figure 3:
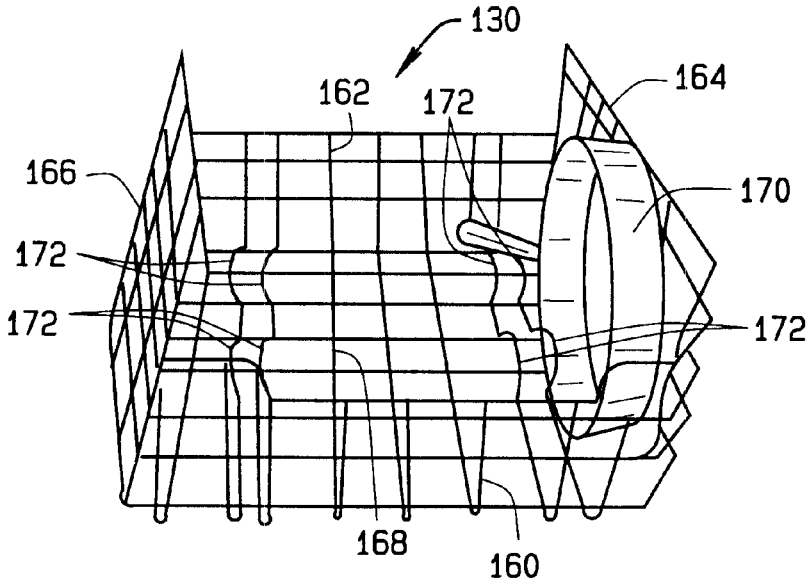
FIG. 3 is a perspective view of a lower rack for the cookware washer system shown in FIGS. 1 and 2.

FIG. 3 is a perspective view of lower rack 130 for the cookware washer 100 (shown in FIGS. 1 and 2). Lower rack 130 includes opposite front and back sides 160, 162, lateral sides 164, 166 extending between respective edges of front and rear sides 160, 162, and a substantially flat and unobstructed bottom 168 extending between lower edges of respective front and back sides 160, 162 and lateral sides 164, 166. Each of rack sides 160, 162, 164, 166 and rack bottom 168 are formed by a plurality of heavy duty wire members, and rack lateral sides 164, 166 are extended to accommodate large cookware items, such as frying pan 170 without the items contacting side walls of cookware washer tub 104 (shown in FIG. 1).

Rack bottom 168 includes a plurality of cookware retainers 172 in which the wire members are upwardly extended in a curved configuration to facilitate placement of cookware items 170 in an upright position. Retainers 172, in one embodiment, are integrally formed into continuously extending wire members in rack bottom 168 between rack front and back sides 160, 162. Thus, additional frying pans, cookie sheets, baking plates, etc. may be contained side-by-side in an upright position between retainers 172 and rack lateral sides 164, 166. In a further embodiment, retainers 172 are relatively low profile or, in other words, extend above rack bottom 162 a sufficient amount to retain cookware items without compromising an ability to place other cookware, such a stock pot (not shown) over retainers 172. Due to the flat unobstructed bottom 168 of rack 130 and to the positions of retainers 172, a wide variety of cookware items can be placed in lower rack 130.

While the illustrated embodiment includes eight retainers 172, it is appreciated that more or less retainers 172 may be employed in alternative embodiments within the scope of the present invention. Additionally, it is contemplated that other retainers could be employed in alternative embodiments in lieu of retainers 172. For example, retainers similar to conventional upstanding tines commonly used in dishwasher racks may be employed, albeit with appropriate modification for employment with heavy duty lower rack 130.

Figure 4:
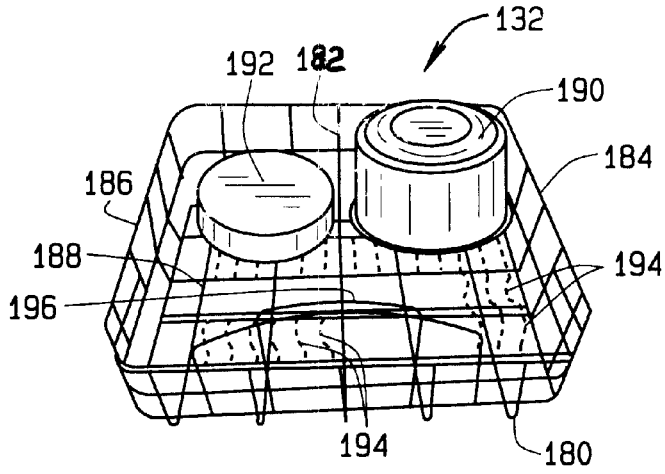
FIG. 4 is a perspective view of an upper rack for the cookware washer system shown in FIGS. 1 and 2.

FIG. 4 is a perspective view of upper rack for 132 for cookware washer 100 (shown in FIGS. 1 and 2). Upper rack 132 includes opposite front and back sides 180, 182, lateral sides 184, 186 extending between respective edges of front and rear sides 180, 182, and a substantially flat and unobstructed bottom 188 extending between lower edges of respective front and back sides 180, 182, and lateral sides 184, 186. Each of rack sides 180, 182, 184, 186 and rack bottom 188 are formed by a plurality of heavy duty wire members, and rack lateral sides 184, 186 are extended to accommodate cookware items, such as sauce pan 190 and casserole dish 192 without the items contacting side walls of cookware washer tub 104 (shown in FIG. 1).

In one embodiment rack bottom 188 includes a plurality of fold down tines 196 (shown in phantom in FIG. 4). Tines 196 are selectively positionable between a folded position substantially flush with rack bottom 188, and an upright position (not shown) wherein tines 196 extend substantially vertically from rack bottom 188. When in the upright position, a plurality of cookware items, such as lids for pots and pans, may be arranged side-by-side between the tines and in an upright position. When tines 196 are folded down, cookware items may be placed face down on rack bottom 88, as illustrated with pan 190 and casserole dish 192. A raised handle portion 196 extends upwardly from rack front side 180.

In an alternative embodiment, rack 132 includes retainers similar to retainers 172 (shown in FIG. 3) in lieu of tines 196.

Aside from rack 130 (shown in FIG. 3) and rack 132 (shown in FIG. 4) that are each configured to accept a multitude of cookware items in an efficient and organized fashion, cookware washer 100 (shown in FIGS. 1 and 2) also includes a control system, unlike conventional dishwashers, that is adapted especially for adequately washing and drying and cookware placed in cookware wash chamber 106 (shown in FIG. 1).

Figure 5:
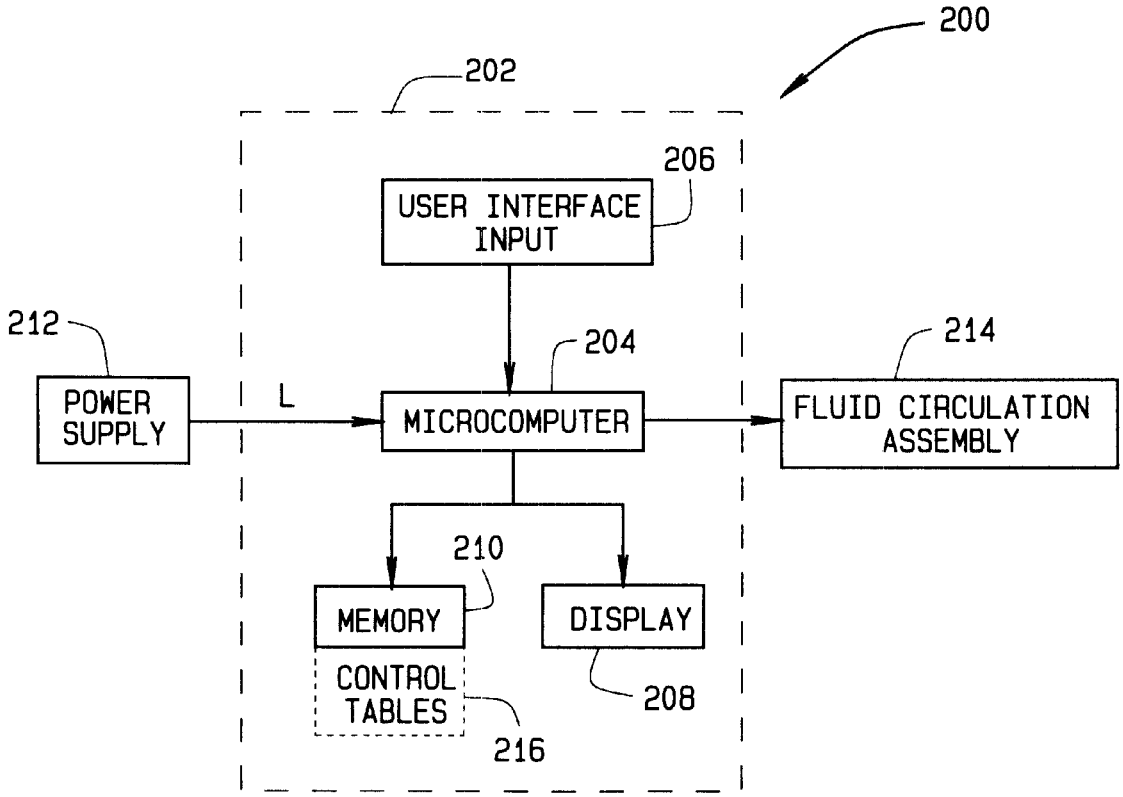
FIG. 5 is a schematic block diagram of the cookware washer system shown in FIGS. 1 and 2.

FIG. 5 is a schematic block diagram of a cookware washer control system 200 for use with cookware washer 100 (shown in FIGS. 1 and 2). Control system 200 includes a controller 202 which may, for example, be a microcomputer 204 coupled to a user interface input 206. An operator may enter instructions or select desired cookware washer cycles and features via user interface input 206, and a display 208 coupled to microcomputer 204 displays appropriate messages, indicators, a timer, and other known items of interest to cookware washer users. A memory 210 is also coupled to microcomputer 204 and stores instructions, calibration constants, and other information as required to satisfactorily complete a selected wash cycle. Memory 210 may, for example, be a random access memory (RAM). In alternative embodiments, other forms of memory could be used in conjunction with RAM memory, including but not limited to electronically erasable programmable read only memory (EEPROM).

Power to system 200 is supplied to controller 202 by a power supply 212 configured to be coupled to a power line L. Analog to digital and digital to analog converters (not shown) are coupled to controller 202 to implement controller inputs and executable instructions to generate controller output to a fluid circulation assembly 214 according to known methods. Fluid circulation assembly 214 includes a water pump, water heater, water filters, etc. to deliver washing fluids and rinses to spray-arm assemblies 144, 148 (shown in FIG. 1). In response to manipulation of user interface input 206, controller 202 monitors various operational factors of cookware washer 100, and executes operator selected functions and features according to known methods. Of course, controller 202 may be used to control system elements and execute functions beyond that specifically described herein.

Controller 202 operates the various components of fluid circulation assembly 214 in a designated wash cycle familiar to those in the art of dishwashers.

However, and unlike known dishwasher systems, controller 202 executes extended wash cycles adequate to remove baked-on adhered food product and residue from cookware. More specifically, controller memory 210 includes a plurality of lookup tables 216 including constants and function parameters for operation of fluid circulation assembly 214 in response to a selected wash cycle via manipulation of user interface input 206. However, each of the lookup tables 216 includes data pertaining to cookware wash cycles, i.e., wash cycles specifically created to address baked-on adhered residues common to cookware.

For example, washing efficacy of cookware in cookware washer 100 is largely attributable to three parameters, wash cycle time (in part a function of the number of water fills of the sump portion for circulation in wash chamber 106 by fluid circulation assembly 214), a water temperature of the water fills, and the detergent composition used in cookware washer 100. It has been found that with appropriate adjustment of the cycle time and the water temperature, cookware may be adequately washed with conventional dishwasher detergents.

For example, an approximate comparison of a typical dishwasher operation and a cookware washer cycle for cookware washer 100 (shown in FIGS. 1 and 2) appears in the tables below for a variety of washer settings.

TABLE 1

| CYCLE | DISHWASHER FILLS | WATER TEMP (° F.) | CYCLE TIME (minutes) |
|---|---|---|---|
| Heavy, Sanitation Temperature | 6 | 160 | 76 |
| Normal, High Temperature | 5 | 135 | 67 |
| Light, Normal Temperature | 4 | 125 | 26 |

TABLE 2

| CYCLE | COOKWARE FILLS | WATER TEMP (° F.) | CYCLE TIME (minutes) |
|---|---|---|---|
| Heavy, Sanitation Temperature | 7 | 171 | 107 |
| Normal, High Temperature | 5 | 145 | 89 |
| Light, Normal Temperature | 4 | 135 | 37 |

Therefore, with increased cycle time and increased temperatures, cookware may be effectively washed in cookware washer 100. Of course, other acceptable cookware cycles may be empirically or theoretically determined.

Control parameters to drive the cycle length, water fills, and water temperature to acceptable levels for washing cookware, such as those set forth above, are believed to be within the purview of those in the art and beyond the scope of the present invention. It is further believed that one of ordinary skill in the art would be able to construct and program such a cookware washer controller without further explanation.

A convenient domestic cookware washer system is therefore provided in a compact and comparatively cost effective package in relation to known commercial pot and pan washing machines. Cookware washer 100 may be inconspicuously mounted under a countertop in a residential kitchen and in one embodiment occupies approximately the same space as a conventional dishwasher. Time intensive hand washing of cookware items is substantially avoided by virtue of cookware washer 100, thereby increasing convenience in residential kitchens and allowing more time for entertainment of guests and pursuit of worthier interests.

While the invention has been described in terms of various specific embodiments, those skilled in the art will recognize that the invention can be practiced with modification within the spirit and scope of the claims.

What is claimed is:

1. A cookware washer comprising:

a tub comprising an inner side wall defining a wash chamber;

a lower rack positioned within said wash chamber, said lower rack comprising first and second opposite sides and a substantially unobstructed bottom surface and a side wall extending therefrom, said side wall and said lower rack configured to accommodate cookware to prevent the cookware from contacting said inner side wall of said wash chamber; and at least one continuously extending wire member extending between said first and second sides, said wire member comprising a cookware retainer portion upwardly extending from said lower rack bottom surface, said side wall extending from said bottom surface cooperating with said wire member to support the cookware in a substantially vertical position.

2. A cookware washer in accordance with claim 1 further comprising a pivotally mounted door assembly closing access to said wash chamber, said door assembly pivoting about a horizontal axis.

3. A cookware washer in accordance with claim 1 further comprising an upper rack positioned within said wash chamber, said upper rack comprising a substantially unobstructed bottom surface.

4. A cookware washer in accordance with claim 3 wherein said upper rack and said lower rack are positioned with respect to one another to provide a clearance therebetween of about 15 inches.

5. A cookware washer in accordance with claim 1 further comprising a controller and a fluid circulation assembly operatively coupled to said controller, said controller configured to operate said fluid circulation assembly for an extended cookware washing cycle.

6. A cookware washer in accordance with claim 5, said controller further configured to operate said fluid circulation assembly at elevated temperatures.

7. A cookware washer comprising:

a wash chamber;

a lower rack slidably coupled to said wash chamber, said lower rack comprising first and second opposite sides and a substantially flat and unobstructed bottom surface adapted for retaining cookware and a side wall extending therefrom, said side wall and said lower rack configured to accommodate cookware to prevent the cookware from contacting an inner side wall of said wash chamber;

at least one continuously extending wire member extending between said first and second sides, said wire member comprising a cookware retainer portion upwardly extending from said lower rack bottom surface, said side wail extending from said bottom surface cooperating with said wire member to support the cookware in a substantially vertical position;

a fluid circulation assembly comprising a lower spray arm assembly proximate said lower rack; and a controller operatively coupled to said fluid circulation assembly, said controller configured to operate said fluid circulation assembly for an extended time period and at elevated temperatures to clean soiled cookware items.

8. A cookware washer in accordance with claim 7 further comprising an upper rack slidably coupled to said wash chamber, said upper rack comprising a substantially flat and unobstructed bottom surface.

9. A cookware washer in accordance with claim 8 wherein said upper rack bottom surface is positioned relative to said lower rack bottom surface to provide a clearance of at least 14 inches.

10. A cookware washer in accordance with claim 7 further comprising a mid-level spray-arm assembly coupled to said upper rack, said mid-level spray-arm assembly positioned with respect to said lower rack bottom surface to provide a clearance therebetween of about 15 inches.

11. A cookware washer for washing cookware items having baked-on food residue, said cookware washer comprising:

a tub comprising a wash chamber;

an upper rack coupled to said wash chamber and comprising a substantially fiat bottom surface adapted for retaining cookware items;

a lower rack coupled to said wash chamber and comprising first and second opposite sides and a substantially flat bottom surface adapted for retaining cookware items, and a side wall extending therefrom, said side wail and said lower rack configured to accommodate cookware to prevent the cookware from contacting an inner side wall of said wash chamber, each from said upper and lower rack horizontally positionable within said wash chamber at least one continuously extending wire member extending between said first side and said second side, said wire member comprising a cookware retainer portion upwardly extending from said lower rack bottom surface, said side wall extending from said bottom surface cooperating with said wire member to support the cookware in a substantially vertical position;

a fluid circulation assembly in flow communication with said wash chamber; and a controller operatively coupled to said fluid circulation assembly and configured to operate said fluid circulation assembly for an extended time period and at elevated temperatures remove baked-on residue.

12. A cookware washer in accordance with claim 11 further comprising a door assembly pivotally mounted to said tub, said door assembly pivoting about a horizontal axis.

13. A cookware washer in accordance with claim 11, said controller comprising a microcomputer and a memory, said memory comprising at least one lookup table including parameters for a cookware wash cycle for said extended time period and at elevated temperature.

14. A residential cookware washer for washing cookware items having baked-on food residue, said cookware washer comprising:

a tub comprising a wash chamber;

at least one heavy duty rack coupled to said tub and adapted for horizontal movement between an extended position and a retracted position relative to said wash chamber, said at least one rack comprising first and second opposite sides and a substantially flat bottom surface adapted for retaining cookware items, and a side wall extending therefrom, said side wall and paid at least one rack configured to accommodate cookware to prevent the cookware from contacting an inner side wall of said wash chamber, said at least one rack located in said wash chamber to provide a vertical clearance of at least 14 inches for cookware items;

at least one continuously extending wire member extending between said first and said second side, said wire member comprising a cookware retainer portion upwardly extending from said bottom surface of said at least one rack, said side wall extending from said bottom surface cooperating with said wire member to support the cookware in a substantially vertical position;

a door assembly pivotally mounted to said tub and selectively positionable about a horizontal axis between an open position providing access to said wash chamber and a closed position closing said wash chamber;

a fluid circulation assembly in flow communication with said wash chamber; and a controller operatively coupled to said fluid circulation assembly and configured to operate said fluid circulation assembly for an extended time period and at elevated temperatures to remove baked-on residue from cookware located in said at least one rack.

15. A residential cookware washer in accordance with claim 14 further comprising a cabinet, said cabinet dimensioned for under-the-counter installation.

16. A residential cookware washer in accordance with claim 14 wherein said retainer portion is curved.

17. A residential cookware washer in accordance with claim 16, said bottom surface further comprising a plurality of retainer portions.

18. A residential cookware washer in accordance with claim 14 wherein said at least one rack comprises an upper rack and a lower rack with a clearance therebetween of at least 15 inches.

* * * * *

UNITED STATES PATENT AND TRADEMARK OFFICE

CERTIFICATE OF CORRECTION

PATENT NO. : 6,666,220 B2
DATED : December 23, 2003
INVENTOR(S) : Spanyer et al.

It is certified that error appears in the above-identified patent and that said Letters Patent is hereby corrected as shown below:

Column 9,
Line 8, delete “wail” and insert therefor -- wall --.
Line 37, delete “fiat” and insert therefor -- flat --.
Line 45, delete “each from” and insert therefor -- each of --.

Column 10,
Line 21, delete “paid” and insert therefor -- said --.
Line 29, between “said first” and “and said second”, insert -- side --.

Signed and Sealed this

Eighteenth Day of May, 2004

JON W. DUDAS
*Acting Director of the United States Patent and Trademark Office*